US010232431B2

(12) United States Patent
Wang et al.

(10) Patent No.: US 10,232,431 B2
(45) Date of Patent: Mar. 19, 2019

(54) PRODUCTION METHOD OF CASTINGS AND GAS-PERMEABLE CASTING MOLD

(71) Applicant: HITACHI METALS, LTD., Tokyo (JP)

(72) Inventors: Lin Wang, Moka (JP); Yoshimasa Fujii, Moka (JP); Toru Iwanaga, Moka (JP)

(73) Assignee: HITACHI METALS, LTD., Tokyo (JP)

( * ) Notice: Subject to any disclaimer, the term of this patent is extended or adjusted under 35 U.S.C. 154(b) by 120 days.

(21) Appl. No.: 15/121,654

(22) PCT Filed: Dec. 19, 2014

(86) PCT No.: PCT/JP2014/083773

§ 371 (c)(1),
(2) Date: Aug. 25, 2016

(87) PCT Pub. No.: WO2015/129134

PCT Pub. Date: Sep. 3, 2015

(65) Prior Publication Data

US 2016/0361757 A1 Dec. 15, 2016

(30) Foreign Application Priority Data

Feb. 28, 2014 (JP) ..... 2014-037839
Apr. 1, 2014 (JP) ..... 2014-075070

(51) Int. Cl.
*B22C 9/08* (2006.01)
*B22D 18/04* (2006.01)
(Continued)

(52) U.S. Cl.
CPC ..... *B22C 9/02* (2013.01); *B22C 9/082* (2013.01); *B22D 18/04* (2013.01); *B22D 27/13* (2013.01)

(58) Field of Classification Search
CPC ..... B22C 9/08; B22C 9/082; B22D 18/04; B22D 27/09; B22D 27/13
(Continued)

(56) References Cited

U.S. PATENT DOCUMENTS 2,155,800 A * 4/1939 Perazo ..... B22C 9/082 164/162
3,256,571 A * 6/1966 Lund ..... B22C 9/082 164/212
(Continued)

FOREIGN PATENT DOCUMENTS

JP 60130447 A * 7/1985
JP 6229844 U 2/1987
(Continued)

OTHER PUBLICATIONS

EPO machine translation of JP 60130447 A (Year: 1985).*
(Continued)

*Primary Examiner* — Kevin E Yoon
(74) *Attorney, Agent, or Firm* — Sughrue Mion, PLLC

(57) ABSTRACT

A method for producing a casting using a gas-permeable casting mold comprising a cavity composed of a production cavity and a flow path, the flow path comprising a sprue through which a gravity-poured melt flows downward, and a runner connecting the production cavity to the sprue, comprising gravity-pouring a metal melt in a volume smaller than that of the entire cavity and larger than that of the production cavity into the gas-permeable casting mold; supplying a gas through the sprue to push the metal melt in the flow path, thereby pushing the metal melt upward in the production cavity, so that the production cavity is filled with the metal melt; in a hypothetical equilibrium state in which a hypothetical liquid fills the production cavity by the supplied gas, setting the volume of the metal melt to be poured to be equal to the volume of the hypothetical liquid, such that the surface height hs of the hypothetical liquid remaining in the flow path after filling the production cavity, the height h1 of the lowest ceiling portion of the runner, and the height h2 of a point at which a ceiling of the runner is connected to the sprue, meet the relation of h2>hs>h1.

1 Claim, 11 Drawing Sheets

(51) Int. Cl.
*B22D 27/13* (2006.01)
*B22C 9/02* (2006.01)

(58) Field of Classification Search
USPC ..... 164/119, 120
See application file for complete search history.

(56) References Cited

U.S. PATENT DOCUMENTS 4,614,217 A * 9/1986 Keaton ..... B22C 9/08
164/130
2009/0151887 A1 6/2009 Goka

FOREIGN PATENT DOCUMENTS

JP 04-052068 A 2/1992
JP 2007-075862 A 3/2007
JP 2010-269345 A 12/2010

OTHER PUBLICATIONS

International Search Report for PCT/JP2014/083773 dated Mar. 31, 2015 [PCT/ISA/210].
Communication dated Jul. 17, 2018, from the Japanese Patent Office in counterpart application No. 2016-505008.

* cited by examiner

PRODUCTION METHOD OF CASTINGS AND GAS-PERMEABLE CASTING MOLD

CROSS REFERENCE TO RELATED APPLICATIONS

This application is a National Stage of International Application No. PCT/JP2014/083773 filed Dec. 19, 2014 (claiming priority based on Japanese Patent Application Nos. 2014-037839 filed Feb. 28, 2014 and 2014-075070 filed Apr. 1, 2014), the contents of which are incorporated herein by reference in their entirety.

FIELD OF THE INVENTION

The present invention relates to a method, which may be called "gas-pressurized casting method" hereinafter, and a gas-permeable casting mold for producing a casting by gravity-pouring a metal melt in a volume smaller than that of an entire cavity and larger than that of a production cavity into a gas-permeable casting mold, and then supplying a gas through a sprue to push the metal melt upward in the production cavity through a flow path, so that a desired cavity portion is filled with the metal melt.

BACKGROUND OF THE INVENTION

In the production of castings by gravity pouring, which may be called simply "pouring" below, a so-called sand mold, which is a gas-permeable casting mold formed by sand particles, is most commonly used. When a melt is charged into such a gas-permeable casting mold, which may be called simply "casting mold," a gas (generally air) remaining in a cavity having a particular shape is discharged through the cavity surface, so that the cavity is fully filled with the metal melt, which may be called simply "melt" below, resulting in a casting having substantially the same shape as that of the cavity. The casting cavity generally comprises a sprue, a runner, a riser and a product-forming cavity in this order from the melt-supplying side. In conventional technology, pouring is completed by forming a melt head as high as filling a product-forming cavity in a sprue.

A solidified casting has a shape corresponding to combined shapes of a sprue, a runner, a riser and a product-forming cavity. The riser is not an unnecessary portion as a cavity for obtaining a good product, while the sprue and the runner are inherently unnecessary portions because they are merely paths for a melt to flow to the product-forming cavity. Accordingly, as long as a melt is solidified in a state of filling the sprue and the runner, drastic improvement in a pouring yield cannot be obtained. In a case where unnecessary cast portions are integrally connected to a cast product, unnecessary cast portions should be separated from the cast product in a subsequent step, resulting in low production efficiency. Accordingly, cast portions in the sprue and the runner pose a serious problem in gravity pouring.

JP 2007-75862 A and JP 2010-269345 A propose a method of drastically solving the above problem, which comprises gravity-pouring a melt in a volume smaller than that of the entire cavity and substantially equal to that of a desired cavity portion, part of a gas-permeable casting cavity which may be called simply "cavity," to charge the metal melt into the desired cavity portion; supplying a compressed gas through a sprue before the poured melt is solidified, such that the desired cavity portion is filled with the melt; and then solidifying the melt. Because pressure provided by the melt head is obtained by the compressed gas by this method, it is expected that a melt need not exist in the sprue and the runner.

Problems to be Solved by the Invention

As a result of investigation for materializing the methods described in JP 2007-75862 A and JP 2010-269345 A, the inventors have found that when a melt in a volume corresponding to that of a desired cavity portion is poured, part of a gas supplied may likely intrude into a product-forming cavity or a riser because of disturbance in the supplying speed and pressure of a gas due to unstable operation of a gas-supplying means, resulting in defects such as misrun and shrinkage voids. This phenomenon will be explained below referring to the attached drawings.

FIGS. 8(*a*) to 8(*c*) exemplifies the steps of the gas-pressurized casting of JP 2007-75862 A and JP 2010-269345 A. A casting mold 101, which is a green sand mold, an example of gas-permeable casting molds, comprises an upper mold 101*a* supported by an upper flask 102*a* constituting a casting mold flask 102, and a lower mold 101*b* supported by a lower flask 102*b* constituting the casting mold flask 102, which are combined and placed on a flat plate 103. A cavity 104 comprises a production cavity 105 composed of a product-forming cavity 105*a* and a riser 105*b*, a horizontal runner 107 connected to the production cavity 105 as part of a flow path 106, and a sprue 108 connected to the runner 107 as part of the flow path 106 through which a melt flows downward.

FIG. 8(*a*) shows a state immediately after a melt M is gravity-poured in a volume substantially equal to the volume of the production cavity 105 (desired cavity portion) composed of the product-forming cavity 105*a* and the riser 105*b*, from a melt-pouring means (not shown) to the sprue 108. FIG. 8(*b*) shows a subsequent state, in which a gas G ejected from a gas-supplying means 100 is supplied through the sprue 108 to push the melt M to fill the production cavity 105. Thus, when a gas is supplied under proper pressure, the production cavity 105 is filled with the melt M, providing a good casting.

However, if there were disturbance in the speed and pressure of a gas G supplied for some reasons, as shown in FIG. 8(*c*), the gas G would flow faster than the melt M along a ceiling of the runner 107 to intrude into the production cavity 105. As a result, the melt M is not sufficiently pushed into the production cavity 105, likely resulting in defects such as misrun and shrinkage voids in castings.

The inventors' investigation has revealed that when a proper gas-supplying state is kept in the methods of JP 2007-75862 A, etc., a metal melt is given inertia, clogging the runner. Because a metal melt clogging the runner by sufficient inertia is quickly solidified, a gas does not flow faster than the melt into a production cavity, so that the production cavity is properly filled with the metal melt. However, with variations in a gas-supplying state due to insufficient pressure, etc., the gas may flow faster than the melt to intrude into the product-forming cavity along a ceiling of the runner. An effective solution of this problem has not been proposed yet.

Accordingly, to mass-produce castings stably by gas-pressurized casting, gas-supplying conditions for proper gas pressure should be investigated and strictly controlled in mass production. However, because the production cavities have various sizes and shapes, their changes likely cause defects such as misrun, shrinkage voids, etc. in castings as described above, at least until the above-described strict control is established.

It has been found that the above-described defects occur more likely when a smaller amount of a melt is poured, namely, when the volume of a melt is closer to the volume of a desired cavity portion, a necessary minimum volume for obtaining a good casting, and that the defects occur less as the amount of a melt poured increases. However, the pouring of a melt in a larger amount than necessary undesirably leads to a lower yield. Accordingly, to obtain good castings with a high pouring yield, it is necessary to develop a casting method using a necessary and sufficient amount of a melt to prevent the intrusion of a gas into a production cavity.

OBJECT OF THE INVENTION

Accordingly, an object of the present invention is to provide a gas-pressurized casting method and a gas-permeable casting mold for producing a casting by pouring a melt in a volume necessary and sufficient for preventing part of a gas supplied from intruding into a product-forming cavity or a riser.

DISCLOSURE OF THE INVENTION

As a result of intensive research in view of the above object, the inventors have found that to minimize influence by control factors such as the pressure and flow rate of a gas supplied, gas-pressurized casting can be conducted without the intrusion of the gas into the production cavity, by taking into consideration the volume of a hypothetical liquid free from solidification, evaporation, expansion, shrinkage, intrusion into a casting mold, and the absorption and desorption of a gas, and a flow path shape, in a hypothetical equilibrium state in which the hypothetical liquid statically fills a production cavity and occupies at least part of a runner. The present invention has been completed based on such finding.

Thus, the method of the present invention for producing a casting using a gas-permeable casting mold comprising a cavity composed of a production cavity and a flow path, the flow path comprising a sprue through which a gravity-poured melt flows downward, and a runner connecting the production cavity to the sprue, comprises gravity-pouring a metal melt in a volume smaller than that of the entire cavity and larger than that of the production cavity into the gas-permeable casting mold;

supplying a gas through the sprue to push the metal melt in the flow path, thereby pushing the metal melt upward in the production cavity, so that the production cavity is filled with the metal melt;

in a hypothetical equilibrium state in which a hypothetical liquid free from solidification, evaporation, expansion, shrinkage, intrusion into a casting mold, and the absorption and desorption of a gas fills the production cavity by the supplied gas, calculating the volume of the hypothetical liquid, such that the surface height hs of the hypothetical liquid remaining in the flow path after filling the production cavity, the height h1 of the lowest ceiling portion of the runner, and the height h2 of a point at which a ceiling of the runner is connected to the sprue, meet the relation of h2>hs>h1; and setting the volume of the metal melt to be poured to be equal to the volume of the hypothetical liquid.

In a hypothetical equilibrium state of a liquid achieved by supplying the gas, the surface height hs of the hypothetical liquid remaining in the flow path and the height ht of the highest bottom portion of the runner preferably meet hs<ht.

The gas-permeable casting mold of the present invention comprises a cavity composed of a production cavity and a flow path, the flow path comprising a sprue through which a gravity-poured melt flows downward, and a runner connecting the production cavity to the sprue for gravity-pouring a metal melt, and then supplying a gas through the sprue to push the metal melt in the flow path, thereby pushing the metal melt upward in the production cavity, so that the desired cavity portion is filled with the metal melt;

the runner comprising a downward-bent flow path provided in an intermediate portion thereof for generating downward flow, a sprue-side flow path connecting an upper portion of the downward-bent flow path to the sprue, and a production-cavity-side flow path connecting a lower portion of the downward-bent flow path to the production cavity; and the height H1 of a point P1 at which a ceiling of the production-cavity-side flow path is connected to the downward-bent flow path, and the height H2 of the lowest ceiling portion P2 of the sprue-side flow path meeting H1<H2.

The height H3 of a point P3, at which a bottom of the sprue-side flow path is connected to the downward-bent flow path, preferably meets H1≤H3.

Effects of the Invention

Because the present invention makes unnecessary strict control of factors such as inertia applied to a charged metal melt, the acceleration of a solidification speed, etc., which are largely affected by the properties of a melt, a cavity shape, etc., good castings can be produced stably.

BRIEF DESCRIPTION OF THE DRAWINGS

FIG. 1(*b*) is a schematic view showing an equilibrium state of a hypothetical liquid pushed into a production cavity by a gas supplied in Embodiment 1 of the present invention.

FIG. 1(*c*) is an enlarged schematic view showing a portion A encircled by a chain line in FIG. 1(*b*), in which a product-forming cavity is connected to a runner.

FIG. 1(*d*) is an enlarged schematic view showing another example similar to Embodiment 1.

FIG. 1(*e*) is an enlarged schematic view showing a further example similar to Embodiment 1.

FIG. 2(*b*) is an enlarged schematic view showing a portion B encircled by a chain line in FIG. 2(*a*), in which a production cavity is connected to a runner.

FIG. 3(*b*) is an enlarged schematic view showing a portion C encircled by a chain line in FIG. 3(*a*), which includes a downward-bent flow path.

FIG. 3(*c*) is an enlarged schematic view showing another example similar to Embodiment 3.

FIG. 3(*d*) is an enlarged schematic view showing a further example similar to Embodiment 3.

FIG. 4(*b*) is an enlarged schematic view showing a portion D encircled by a chain line in FIG. 4(*a*), which includes a runner having a low ceiling.

FIG. 4(*c*) is a perspective view schematically showing a wide runner having a low ceiling.

FIG. 5(*b*) is an enlarged schematic view showing a portion E encircled by a chain line in FIG. 5(*a*), which includes a downward-bent flow path.

FIG. 6(*b*) is an enlarged schematic view showing a portion F encircled by a chain line in FIG. 6(*a*), which includes a downward-bent flow path.

FIG. 7(*b*) is an enlarged schematic view showing a portion H encircled by a chain line in FIG. 7(*a*), which includes a downward-bent flow path.

FIG. 8(*b*) is a schematic view showing another step in the gas-pressurized casting described in JP 2007-75862 A and JP 2010-269345 A.

FIG. 8(*c*) is a schematic view showing a further step in the gas-pressurized casting described in JP 2007-75862 A and JP 2010-269345 A.

DESCRIPTION OF THE PREFERRED EMBODIMENTS

[1] Production Method of Castings

Figure 1A:
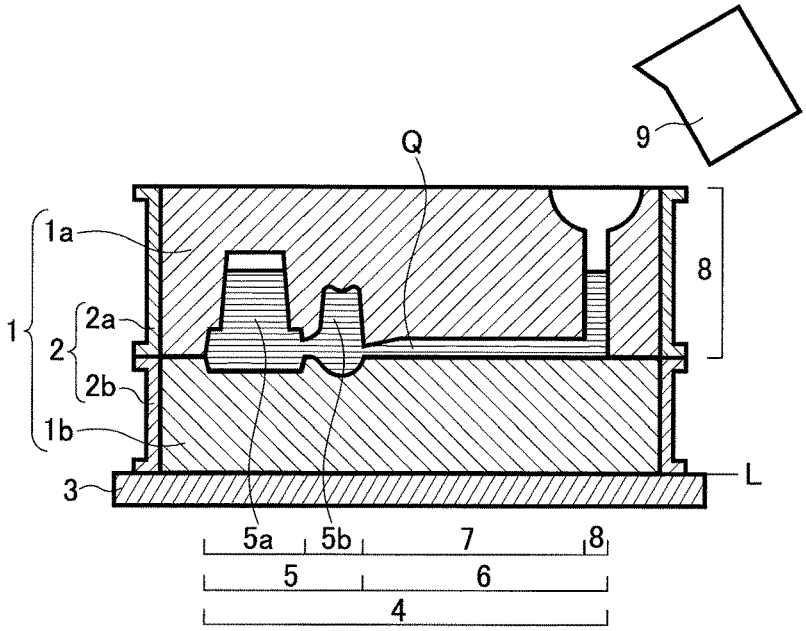
FIG. 1(*a*) is a schematic view showing a state immediately after a hypothetical liquid is poured into a sprue of a casting mold in Embodiment 1 of the present invention.
Figure 1B:
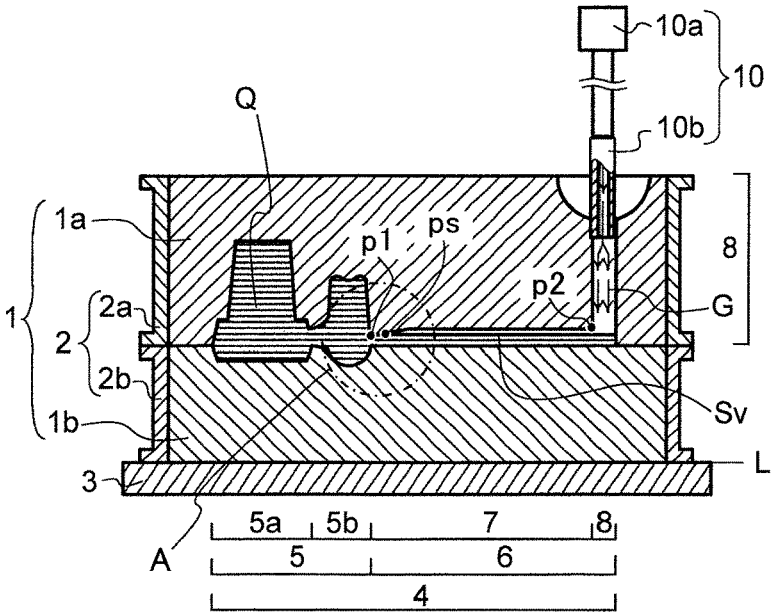
Figure 1C:
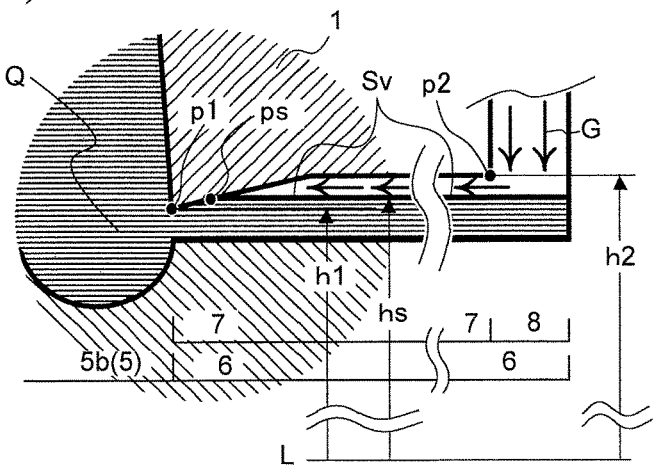
Figure 1D:
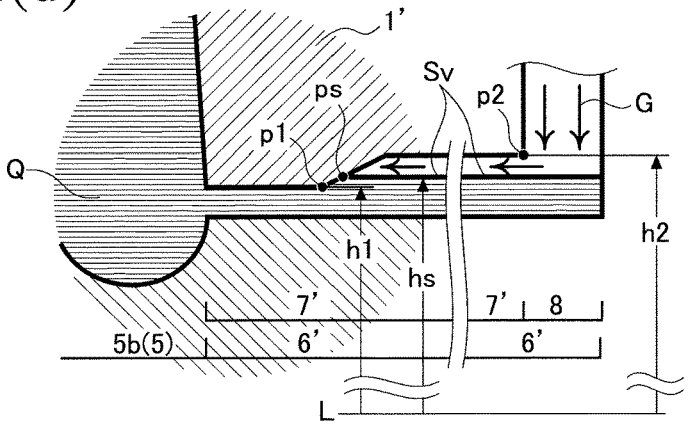
Figure 1E:
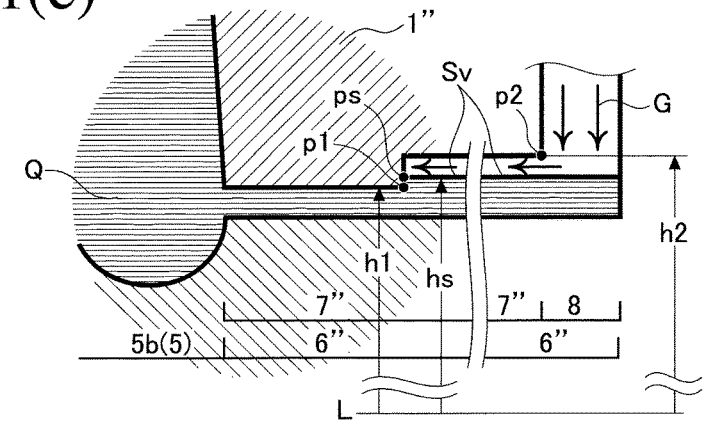

A gas-pressurized casting method, a basic technology of the present invention, will be explained first. The present invention is based on gas-using casting methods (gas-pressurized casting methods) proposed by JP 2007-75862 A and JP 2010-269345 A, though not restricted by the disclosures of these patent references.

The gas-pressurized casting method comprises supplying a metal melt into a flow path through a sprue of gas-permeable casting mold, and supplying a gas through the sprue to push the metal melt in the flow path into a desired cavity portion, so that a production cavity constituting the desired cavity portion is filled with the metal melt. Though pushing a metal melt in a flow path leads to pushing a metal melt in a production cavity upward or downward depending on the arrangement of a production cavity, the method of the present invention is applicable to a case where the metal melt is pushed upward in the production cavity, namely, a case where the production cavity is higher than the runner.

A gas-permeable casting mold used in the present invention is not restricted to have a riser. However, because the riser supplements a melt to a product-forming cavity in which the melt shrinks by solidification, the riser would not sufficiently perform its roll if it were not fully filled with a melt before solidification, resulting in defects such as shrinkage voids, etc. in products. Accordingly, the riser is preferably filled with a melt at least when gas pressuring is completed. The embodiments of the present invention are thus explained, taking for example a case where not only the product-forming cavity but also the riser are filled with a melt. The product-forming cavity, or a cavity comprising both product-forming cavity and riser may be called "production cavity" hereinafter.

Though the gas-permeable casting mold is generally a green sand mold, a shell mold, a self-hardening mold, or any other casting mold composed of sand particles, it may be formed by ceramic or metal particles. Materials having no gas permeability, such as gypsum, can be used for a gas-permeable casting mold, by adding or partially using gas-permeable materials for sufficient gas permeability. Even a casting mold having no gas permeability at all, such as a metal die, may be used as a gas-permeable casting mold, when vents such as vent holes for gas permeability are added.

The melt may be made of metals generally used for the production of castings, such as iron alloys such as cast iron and cast steel, aluminum alloys, copper alloys, magnesium alloys, zinc alloys, etc.

By the gas-pressurized casting method, even a melt in a smaller volume than that of the entire cavity can fill a production cavity by a gas supplied through a sprue. In gravity-pouring casting using a conventional gas-permeable casting mold, a melt filling all cavity including the product-forming cavity should be solidified to obtain a good product, resulting in a pouring yield of at most about 70%, with no drastic improvement expected. On the other hand, the gas-pressurized casting method enables the gravity pouring of a melt in a volume smaller than that of the entire cavity and larger than that of the production cavity, theoretically resulting in a pouring yield of almost 100%.

However, because it has been known from the inventors' investigation as described above that part of a gas supplied may enter the production cavity depending on the gas-supplying conditions, etc. in a conventional gas-pressurized casting method. To compensate this, the volume of a melt poured is not set substantially equal to that of the production cavity for a pouring yield of 100%, but actually increased to such extent that a slight amount of the melt may remain in the runner.

Even though the amount of a melt poured is increased, part of a gas supplied may enter the production cavity when the melt does not fill the runner up to the ceiling. Thus, such a complicated cooling control that a melt is solidified in the runner to plug the runner against gravity may be necessitated as described in, for example, JP 2007-75862 A (FIGS. 6-8) or JP 2010-269345 A (FIG. 8).

In the gas-pressurized casting method of the present invention, the volume of a hypothetical liquid (liquid free from solidification, evaporation, expansion, shrinkage, intrusion into a casting mold, and absorption and desorption of a gas) is calculated, such that the hypothetical liquid remains in the flow path after filling the production cavity when a gas is supplied, the surface height hs of the hypothetical liquid, the height h1 of the lowest point of the runner ceiling, and the height h2 of a connecting point of the runner ceiling to the sprue meeting the relation of h2>hs>h1; and a metal melt in the same volume as that of the hypothetical liquid is poured. The relation of h2>hs>h1 is met, for example, in a state where an excess of the hypothetical liquid after filling the production cavity occupies at least part of the runner [near a connecting point of the runner 27 to the production cavity 5 in FIG. 1(*b*)], without completely filling the runner, as shown in FIGS. 1(*a*) and 1(*b*).

"Plugging at least part of the runner" means that the runner is filled with a hypothetical liquid up to the lowest point of its ceiling, with no vacancy in the flow path communicating from an inlet of the sprue to the production cavity. With a melt poured in the same volume as that of a hypothetical liquid occupying at least part of the runner, it fills the production cavity when a gas is supplied, resulting in a stable horizontal surface of the melt existing in the flow path continuously from the production cavity. Thus, even with variations in the flow rate, pressure, etc. of a gas supplied, a gas supplied theoretically would not enter the production cavity, because the gas supplied pushes the melt surface at least perpendicularly. Accordingly, an operation of solidifying the melt while keeping a non-equilibrium state of the melt pushed by inertia is not needed.

As described above, the hypothetical liquid occupies at least part of the runner without filling the runner, leaving vacancy in part of the runner. With the same volume as that of a hypothetical liquid not filling all of the runner, the amount of a melt poured can be reduced, resulting in a higher pouring yield.

Figure 2A:
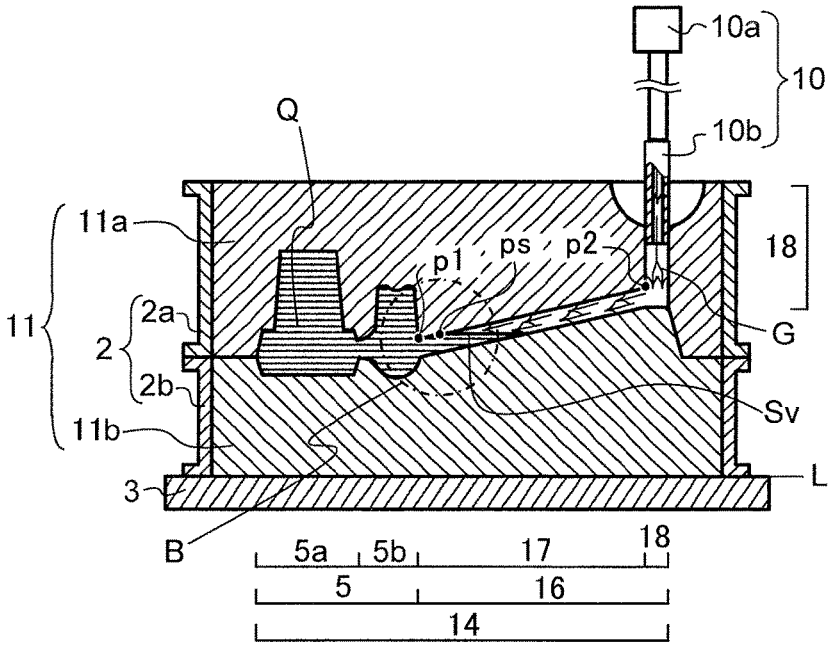
FIG. 2(*a*) is a schematic view showing an equilibrium state of a hypothetical liquid pushed into a production cavity by a gas supplied in Embodiment 2 of the present invention.
Figure 2B:
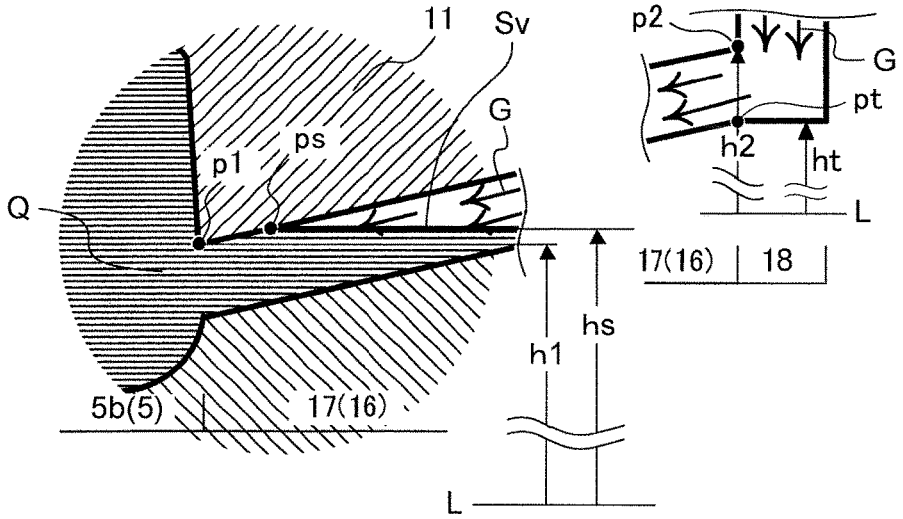
Figure 3A:
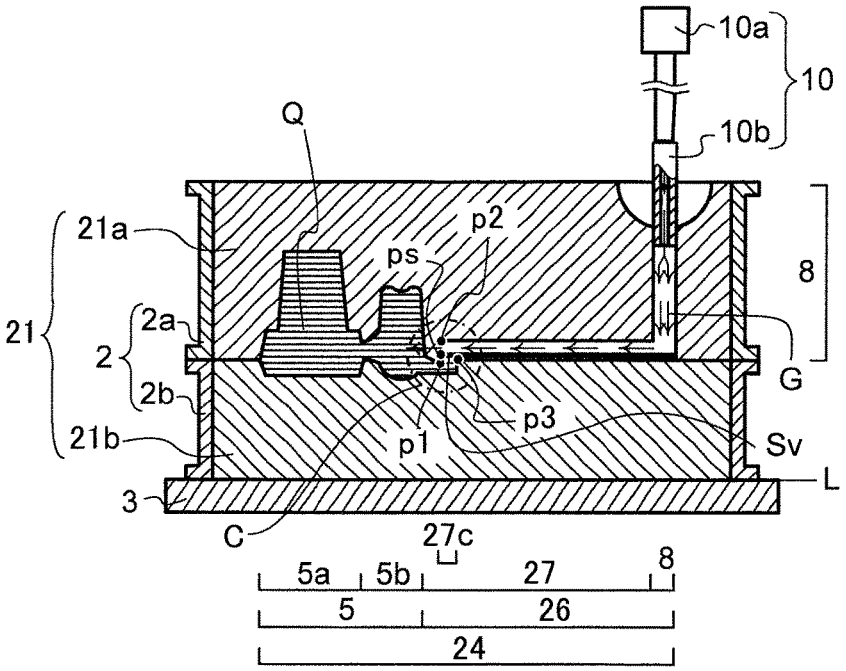
FIG. 3(*a*) is a schematic view showing an equilibrium state of a hypothetical liquid pushed into a production cavity by a gas supplied in Embodiment 3 of the present invention.
Figure 3B:
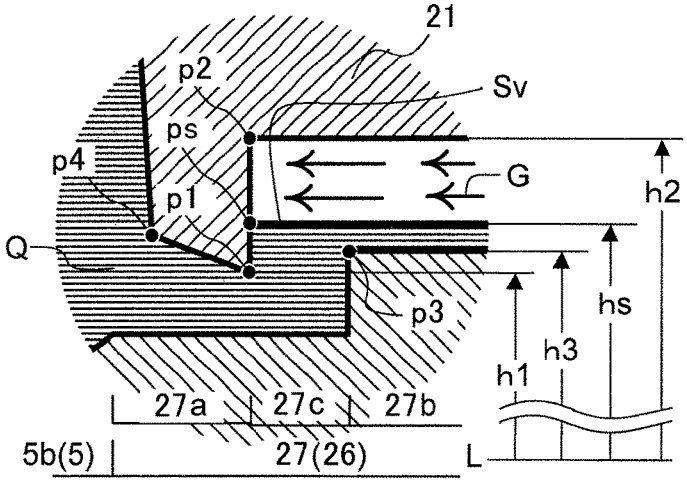
Figure 3C:
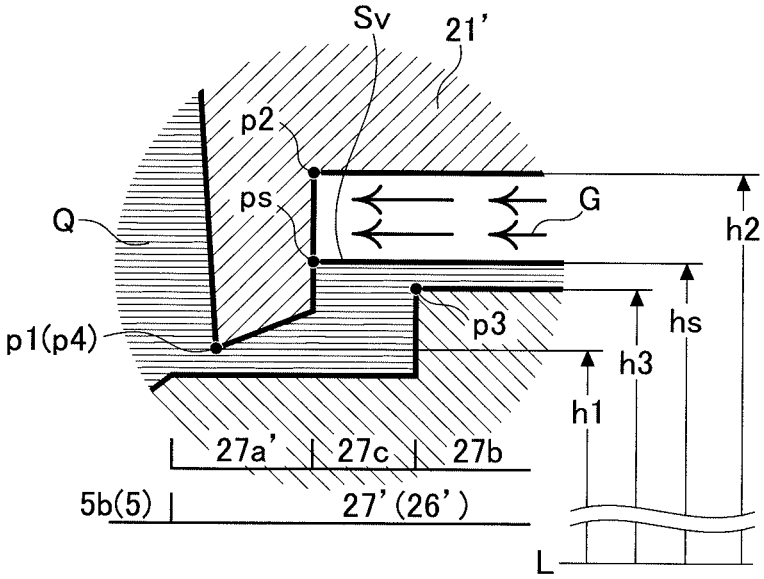
Figure 3D:
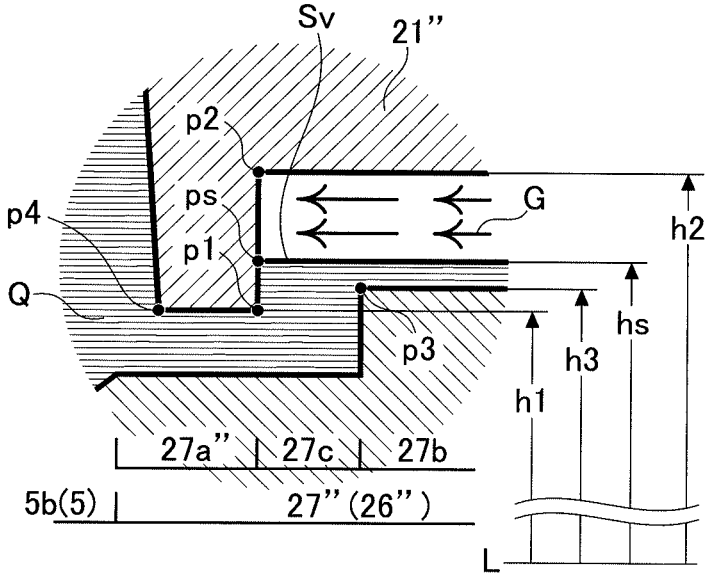

In an equilibrium state of a hypothetical liquid achieved by supplying the gas, a melt in the same volume as that of the hypothetical liquid meeting hs<ht, wherein ht is the height of the highest bottom portion of the runner, is preferably poured as shown in, for example, FIGS. 2(*a*) and 2(*b*). With hs<ht met, the amount of a melt used can be further reduced.

[2] Gas-Permeable Casting Mold

Figure 6A:
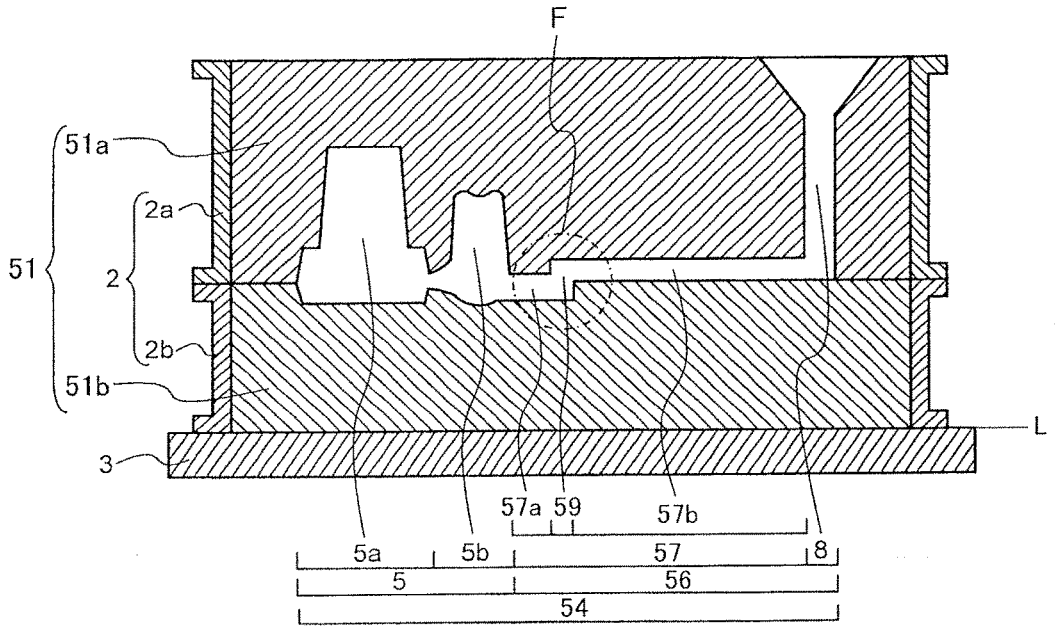
FIG. 6(*a*) is a schematic view showing an example of gas-permeable casting molds in Embodiment 6 of the present invention.
Figure 6B:
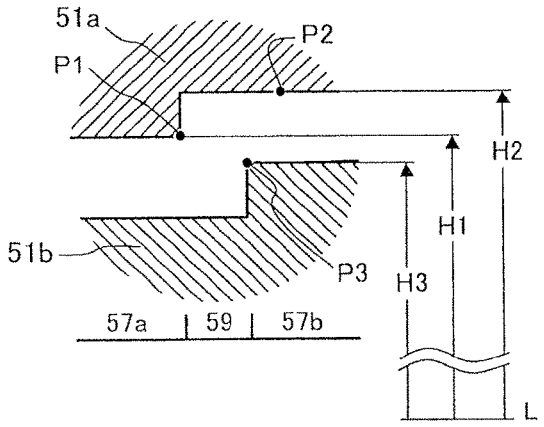

The gas-permeable casting mold of the present invention comprises a cavity comprising a production cavity and a flow path; the flow path comprising a sprue through which a gravity-poured melt flows downward, and a runner connecting the production cavity to the sprue; and the runner having a downward-bent flow path provided in an intermediate portion thereof for downward melt flow, for example, as shown in FIG. 6(*a*). In the gas-permeable casting mold of the present invention, a metal melt is gravity-poured, and then pushed in the flow path by a gas supplied through the sprue, with a metal melt in the production cavity pushed upward, so that the desired cavity portion is filled with the metal melt. It is particularly suitable for the casting method of the present invention.

Because the runner has the downward-bent flow path for downward flow in an intermediate portion thereof, vacancy, if any in the runner ceiling for some reason, would be shut by the connecting point P1 in an equilibrium state, so that part of a gas supplied less likely enters the product-forming cavity or the riser, as long as a melt has a volume reaching the point P1 as high as H1, at which the downward-bent flow path is connected to a ceiling of the flow path extending from the downward-bent flow path to the production cavity as shown in FIG. 6(*b*). To obtain this effect, the height H1 of the connecting point P1, and the height H2 of the lowest ceiling portion P2 of a sprue-side flow path extending from the sprue to the downward-bent flow path should meet the relation of H1<H2.

With a downward-bent flow path provided in its intermediate portion, the runner is constituted by the downward-bent flow path, a sprue-side flow path extending from the sprue to an upper portion of the downward-bent flow path, and a production-cavity-side flow path extending from lower portion of the downward-bent flow path to the production cavity. Namely, the runner is constituted by the sprue-side flow path, the downward-bent flow path, and the production-cavity-side flow path in this order, from the sprue side to the production cavity side. The downward-bent flow path may be vertical or inclined downward from the sprue toward the production cavity, as long as it bends a melt flow from the sprue downward. When the downward-bent flow path is inclined from the sprue toward the production cavity, the production-cavity-side flow path is not indispensable, but the downward-bent flow path may be directly connected to the production cavity.

Larger difference is better between the height H1 of the point P1 at which the ceiling of the production-cavity-side flow path is connected to the downward-bent flow path and the height H2 of the lowest ceiling portion P2 of the sprue-side flow path. When the point P3 at which a bottom of the sprue-side flow path is connected to the downward-bent flow path has a height H3, H1<(H2+H3)/2 is preferable [see FIG. 6(*b*)], and H1≤H3 is more preferable [see FIG. 7(*b*)]. By meeting H1<(H2+H3)/2, further H1≤H3, the amount of a melt used can be further reduced.

The more preferred embodiments of the present invention will be explained below.

To introduce a predetermined amount of a melt into the cavity efficiently, a sprue in the gas-permeable casting mold preferably has a cup portion having a larger diameter than that of a path receiving a melt flowing downward from a melt-pouring means.

Though the gas supplied may be air for cost, it is preferably a non-oxidizing gas such as argon, nitrogen, carbon dioxide, etc. to prevent the oxidation of the melt. Though the gas may be supplied from a fan, a blower, etc., a compressed gas is preferable because it can uniformly push the melt at higher pressure.

The gas-supplying means preferably has a nozzle-shaped portion connected to the sprue. The nozzle-shaped portion can be easily fit (inserted) into the sprue (particularly a pipe portion connected to the sprue cup portion), enabling the quick connection of the gas-supplying means.

The nozzle preferably has a tapered side surface. With a tapered wall complementary to the sprue (pipe portion), the nozzle can be surely fit into the sprue (pipe portion).

To solidify the charged melt while preventing its reverse flow, a method of continuing as high a gas-supplying pressure as preventing the reverse flow of a pushed-up melt, a method of introducing water through a sprue to accelerate the solidification of a melt, and other methods described in JP 2007-75862 A and JP 2010-269345 A can be used.

[3] Embodiments

Various embodiments will be explained in detail below referring to the attached drawings. To make clear the features of the present invention, the embodiments are explained below referring to vertical cross sections each including a production cavity and a flow path, though an actual cavity generally has portions perpendicular to a paper surface. It should be noted that embodiments described below are merely typical examples, to which the present invention is not restricted.

Embodiment 1

FIGS. 1(*a*) to 1(*c*) show the steps of statically charging a hypothetical liquid Q according to Embodiment 1 of the present invention. FIGS. 1(*a*) to 1(*c*) show the vertical cross sections of a cavity 4. FIG. 1(*c*) enlargedly shows a portion A encircled by a chain line in FIG. 1(*b*), in which a production cavity 5 is connected to a runner 7.

In Embodiment 1, a green sand mold, which is a gas-permeable casting mold, is used as a casting mold 1. The casting mold 1 is composed of an upper mold 1*a* supported by an upper flask 2*a* constituting a casting mold flask 2, and a lower mold 1*b* supported by a lower flask 2*b* constituting the casting mold flask 2, both molds 1*a*, 1*b* being combined and arranged on a support plate 3. A cavity 4 is constituted by a production cavity 5 comprising a product-forming cavity 5*a*, and a riser 5*b* connected to the product-forming cavity 5*a* on the side of a sprue 8; and a flow path 6 comprising a runner 7 horizontally extending to the production cavity 5, and a sprue 8 connected to the runner 7 for a melt to flow downward; a ceiling of the runner 7 near the production cavity 5 being downward inclined toward the production cavity 5. The production cavity may not have a riser. The same is true in other embodiments below.

FIG. 1(*a*) shows a hypothetical state immediately after a liquid Q is poured from a pouring means 9 into the sprue 8 of the casting mold 1 (pouring completion stage). The liquid Q is a hypothetical liquid free from solidification, evaporation, expansion, shrinkage, intrusion into a casting mold, and the absorption and desorption of a gas, and having a specific gravity of 1, larger than that of a gas G described below. The same is true in other embodiments below.

FIG. 1(*b*) shows a hypothetical equilibrium state, in which with a gas-ejecting nozzle 10*b*, part of a gas-supplying means 10, fit into the sprue 8, a gas G shown by plural arrows is supplied from a gas-supplying member 10*a* into the cavity 4, to statically push the liquid Q in the production cavity 5 upward by the supplying pressure of the gas G (charging equilibrium state). The term "statically" used herein means that the liquid Q is always kept horizontal (perpendicular to a gravity direction) without disturbance of its surface Sv (boundary surface between the liquid Q and the gas G). The same is true in other embodiments. In Embodiment 1, the liquid Q continuously fills the runner 7 up to a liquid surface Sv as high as a point ps, after filling the production cavity 5, as shown in FIG. 1(*c*).

In a state shown in FIGS. 1(*b*) and 1(*c*), the height hs of the surface Sv of the liquid Q remaining in the flow path 6 after filling the production cavity 5 by supplying the gas G, and the height h1 of the lowest ceiling point p1 of the runner 7 meet hs>h1. In this state, the gas G supplied through the sprue 8 does not enter the production cavity 5 without disturbance. Namely, the liquid Q meeting hs>h1 can stably keep an equilibrium state.

Figure 9:
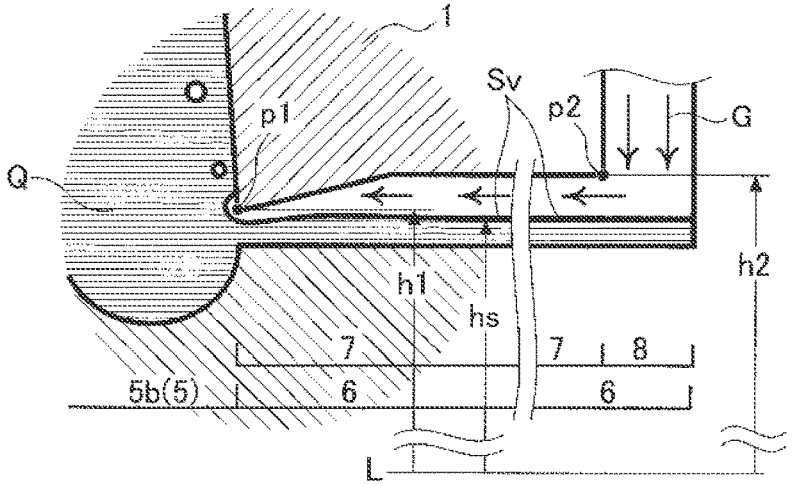
FIG. 9 is a schematic view showing an example outside the present invention, which uses the casting mold shown in FIG. 1(*a*).

When hs>h1 is not met, namely when a liquid Q is poured in a volume of hs<h1, the surface Sv of the liquid Q pushed by the gas G toward the production cavity 5 becomes lower than the lowest ceiling point p1 of the runner 7, as shown in FIG. 9. With the surface Sv lower than p1, the liquid cannot keep an equilibrium state with a horizontal surface, so that the gas G having a smaller specific gravity than that of the liquid Q in the runner 7 intrudes into the production cavity 5 along the ceiling of the runner 7. Though the gas G theoretically does not intrude into the runner 7 in the case of hs=h1, the gas G undesirably enters the runner 7 when slight inclination, vibration, etc. occurs in the casting mold.

As in FIGS. 1(*a*) to 1(*c*), when a liquid Q in a volume meeting hs>h1 is poured, the liquid Q not only fills the production cavity 5, but also its surface Sv is positioned above the lowest point p1 of the runner 7. The gas G having a smaller specific gravity than that of the liquid Q does not intrude into the liquid Q, much less reach the production cavity 5.

In Embodiment 1 shown in FIG. 1(*c*), the lowest ceiling point p1 of the runner 7 is a connecting point to the production cavity 5, lower than a connecting point p2 to the sprue 8. Thus, h2>h1, wherein h2 is the height of the connecting point p2 of the sprue 8. Accordingly, the liquid surface Sv need not be higher than p2 but may be positioned within the runner 7. With h2>hs>h1, the volume of the liquid Q can be preferably reduced.

In actual gas-pressurized casting, the height hs of the liquid surface Sv preferably has a slight height margin to the height h1 of p1. h1+1 mm≤hs≤h1+25 mm is preferable. The same is true in Embodiments 2-5 below. When the liquid surface Sv is slightly higher than the lowest ceiling point p1 of the runner 7 despite hs>h1, for example, when the height hs of the liquid surface Sv meets h1+1 mm>hs>h1, large inertia is preferably added to a metal melt in an actual gas-pressurized casting, with a large pressure increase speed at an early stage of supplying, thereby charging the melt into the production cavity.

Though a reference height plane L may be an arbitrary horizontal plane equal to or lower than the lowest point of the cavity 4, it is an upper surface of a flat plate 3 in Embodiment 1. The same is true in other embodiments.

In a hypothetical equilibrium state shown in FIG. 1(*b*), in which the liquid Q fills the production cavity 5, the volume of a metal melt poured in actual gas-pressurized casting is equal to the volume of the liquid Q continuously occupying the production cavity 5 and the runner up to a liquid surface Sv. By setting the volume of a metal melt to be poured equal to that of a hypothetical liquid Q calculated in the above equilibrium state, castings can be stably produced by a gas-pressurized casting method without permitting the gas G to enter the production cavity 5.

In the casting mold 1 in Embodiment 1, a ceiling portion of the runner 7 downward inclined toward the production cavity 5 is directly connected to the production cavity 5 as shown in FIG. 1(*c*), though not always necessary. As shown in FIG. 1(*d*), for example, the runner 7 may be provided with the above inclined portion in its immediate portion, and the height of a ceiling extending from the lowest point of the inclined portion (the lowest ceiling point p1 of the runner 7) to the production cavity 5 may be the same as the height h1 of the lowest point of the inclined portion. As shown in FIG. 1(*e*), the runner 7 may be provided with a vertical step in place of the inclined portion in its immediate portion.

Though various vertical cross sections of the cavity 4 shown in FIGS. 1(*a*) to 1(*c*) are explained in Embodiment 1, it should be noted that an actual cavity 4 has a three-dimensional shape spreading even in directions perpendicular to the paper surface. Accordingly, a metal melt to be poured should be set to have a volume equal to the volume of a liquid Q determined from the specific design of a cavity 4, computer-simulated casting model dimensions, etc. Generally used in actual production is not the volume of a melt but the weight of a melt. In this case, the weight of a metal melt to be poured is determined by multiplying the calculated volume of the liquid Q by the specific gravity (density) of the melt. The same is true in other embodiments.

Embodiment 2

FIGS. 2(*a*) and 2(*b*) show a hypothetical equilibrium state of charging a liquid Q according to Embodiment 2 of the present invention. The basic structure of a gas-permeable casting mold in Embodiment 2 is the same as in Embodiment 1, except that a casting mold 11 has a runner 17 downward inclined from a sprue 18 to a production cavity 5.

Also the same as in Embodiment 1 are steps until a liquid Q poured into the casting mold is statically pushed upward into a production cavity 5 by the supplying pressure of a gas G.

FIG. 2(*a*) shows a vertical cross section of the cavity 14, and FIG. 2(*b*) enlargedly shows a portion B encircled by a chain line, which includes a connecting point of a runner 17 to a production cavity 5. In Embodiment 2, the liquid Q fills the production cavity 5, and continuously fills the runner 17 up to a liquid surface Sv as high as a point ps. Though the entire runner 17 is inclined in FIGS. 2(*a*) and 2(*b*), part of the runner 17 on the side of the sprue 18 or the production cavity 5 may be horizontal.

In Embodiment 2, too, the liquid Q is in a volume meeting the relation of hs>h1, wherein h1 is the height of the lowest ceiling point p1 of the runner 17 constituting the flow path 16, and hs is the height of the liquid surface Sv, to prevent a gas G from intruding into the production cavity 5, as in Embodiment 1. In Embodiment 2, too, the lowest ceiling point p1 of the runner 17 at a connecting point to the production cavity 5 is lower than a connecting point p2 to the sprue 18, thereby h2>h1, as in Embodiment 1. Accordingly, in Embodiment 2, too, the liquid surface Sv need not be higher than the connecting point p2. The liquid surface Sv may be in the runner 17, meeting h2>hs>h1, preferably reducing the volume of the liquid Q.

As is clear from FIG. 2(*b*), the volume of the liquid Q can be further reduced by meeting hs<ht, wherein ht is the maximum bottom height of the runner 17. In Embodiment 2, the maximum bottom height of the runner 17 is the height of a connecting point pt of the bottom of the runner 17 to the sprue 18.

In actual gas-pressurized casting, a metal melt is poured in a volume of the liquid Q reaching the liquid surface Sv in a hypothetical equilibrium state in which the liquid Q fills the production cavity 5, as shown in FIG. 2(*a*).

Embodiment 3

FIGS. 3(*a*) and 3(*b*) show a hypothetical equilibrium state of charging a liquid Q according to Embodiment 3 of the present invention. The basic structure of a gas-permeable casting mold in Embodiment 3 is the same as in Embodiment 1, except that a casting mold 21 comprises a runner 27 having a downward-bent flow path 27*c* for generating downward flow in its intermediate portion. Also the same as in Embodiment 1 are steps until a liquid Q poured into the casting mold is statically pushed upward into a production cavity 5 by the supplying pressure of a gas G.

FIG. 3(*a*) shows a vertical cross section of the cavity 24, and FIG. 3(*b*) enlargedly shows a portion C encircled by a chain line, which includes a downward-bent flow path 27*c*. In Embodiment 3, the liquid Q fills the production cavity 5, and continuously fills the runner 27 up to a surface Sv as high as a point ps.

With the runner 27 having a horizontal runner portion 27*a* on the side of the production cavity 5 from the downward-bent flow path 27*c*, and a horizontal runner portion 27*b* on the side of the sprue 8 from the downward-bent flow path 27*c*, the lowest ceiling point p1 of the runner 27 corresponds to the lowest ceiling point of the runner 27*a*. Because a ceiling of the runner 27*a* is inclined upward toward the production cavity 5 in FIGS. 3(*a*) and 3(*b*), p1 is a connecting point of the runner 27*a* to the downward-bent flow path 27*c*. When the ceiling of the runner 27*a* is downward inclined toward the production cavity 5 as shown in FIG. 3(*c*), the lowest ceiling point p1 of the runner 27*a* is positioned at a connecting point p4 to the production cavity 5. When the runner 27*a* has a horizontal ceiling as shown in FIG. 3(*d*), the lowest ceiling point p1 of the runner 27*a* is positioned at a connecting point of the runner 27*a* to the downward-bent flow path 27*c*, or at a connecting point p4 to the production cavity 5.

In Embodiment 3 comprising the downward-bent flow path 27*c*, too, the intrusion of a gas G into the production cavity 5 can be prevented by setting the volume of the liquid Q to meet the relation of hs>h1, wherein h1 is the height of the lowest ceiling point p1 of the runner 27 constituting the flow path 26, and hs is the height of the liquid surface Sv. As in Embodiments 1 and 2, the liquid surface Sv can be located at a position meeting h2>hs>h1 in the runner 27, reducing the volume of the liquid Q.

When the height h3 of a connecting point p3 of a bottom of the runner 27*b* to the downward-bent flow path 27*c* meets the relation of h3>h1, the height hs of the liquid surface Sv can be above p1 and equal to or lower than p3, h3≥hs>h1. In this case, the liquid surface Sv does not exist in the runner 27*b*, most preferably reducing the amount of the liquid Q.

In actual gas-pressurized casting, a metal melt is poured in a volume corresponding to the volume of the liquid Q filling up to a liquid surface Sv in addition to filling the production cavity 5 in a hypothetical equilibrium state shown in FIG. 3(*a*).

Embodiment 4

Figure 4A:
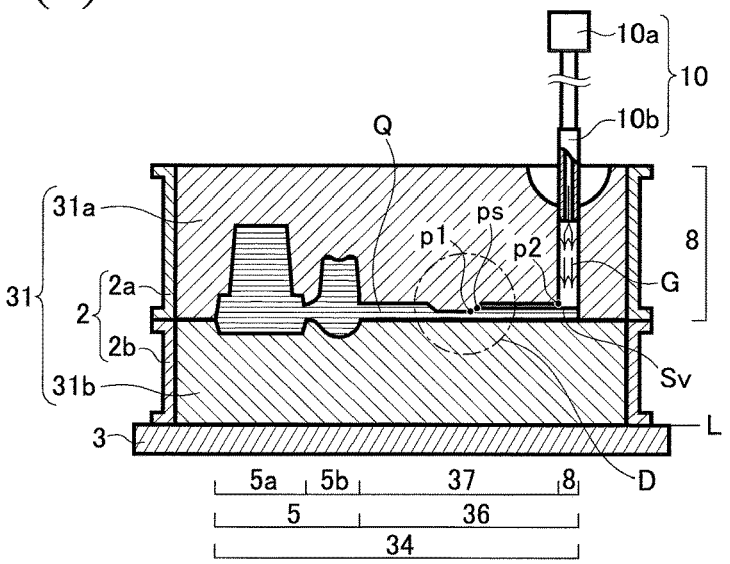
FIG. 4(*a*) is a schematic view showing an equilibrium state of a hypothetical liquid pushed into a production cavity by a gas supplied in Embodiment 4 of the present invention.
Figure 4B:
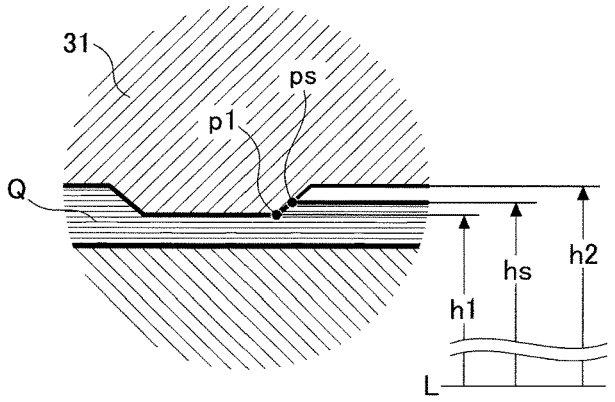
Figure 4C:
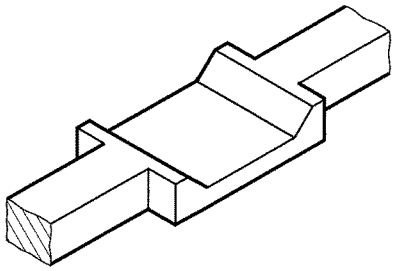

FIGS. 4(*a*) and 4(*b*) show a hypothetical equilibrium state of charging a liquid Q according to Embodiment 4 of the present invention. The basic structure of a gas-permeable casting mold in Embodiment 4 is the same as in Embodiment 1, except that a casting mold 31 comprises a runner 37 having a ceiling lower than other portions in its intermediate portion. Also the same as in Embodiment 1 are steps until the liquid Q poured into the casting mold is statically pushed upward into a production cavity 5 by the supplying pressure of a gas G.

FIG. 4(*a*) shows a vertical cross section of the cavity 34, and FIG. 4(*b*) shows a portion D encircled by a chain line, in which a ceiling of the runner 37 is low in its immediate portion. In Embodiment 4, the liquid Q continuously fills the runner 37 up to a liquid surface Sv as high as a point Ps, after filling the production cavity 5.

In Embodiment 4, too, the volume of the liquid Q is set to have a volume meeting the relation of hs>h1, wherein h1 is the height of the lowest ceiling point p1 of the runner 37 constituting the flow path 36, and hs is the height of the liquid surface Sv, thereby preventing the intrusion of a gas G supplied into the production cavity 5, as in Embodiment 2. In Embodiment 4, the lowest ceiling point p1 is located in an intermediate portion of the runner 37, lower than the connecting point p2 to the sprue 8, as in Embodiments 1-3 described above. Namely, the height h2 of the connecting point p2 to the sprue 8 meets h2>h1. Accordingly, in Embodiment 4, the liquid surface Sv need not be higher than p2. The liquid surface Sv is preferably located in the runner 37, meeting h2>hs>h1, thereby reducing the volume of the liquid Q.

With a low ceiling in an intermediate portion of the runner 37, the solidification of a melt in this portion is accelerated in actual casting, thereby quickly stopping the reverse flow of a melt from the production cavity 5. A low ceiling portion of the runner 37 may be wide as shown in FIG. 4(*c*), though the depicted wide shape is merely an example, not restrictive. With a wide portion of the runner 37, a cross section of the flow path is not reduced by a low ceiling, without hindering melt flow.

The volume of a metal melt poured in actual gas-pressurized casting is equal to the volume of a liquid Q continuously occupying the production cavity 5 and up to a liquid surface Sv in a hypothetical equilibrium state shown in FIG. 4(*a*).

Embodiment 5

Figure 5A:
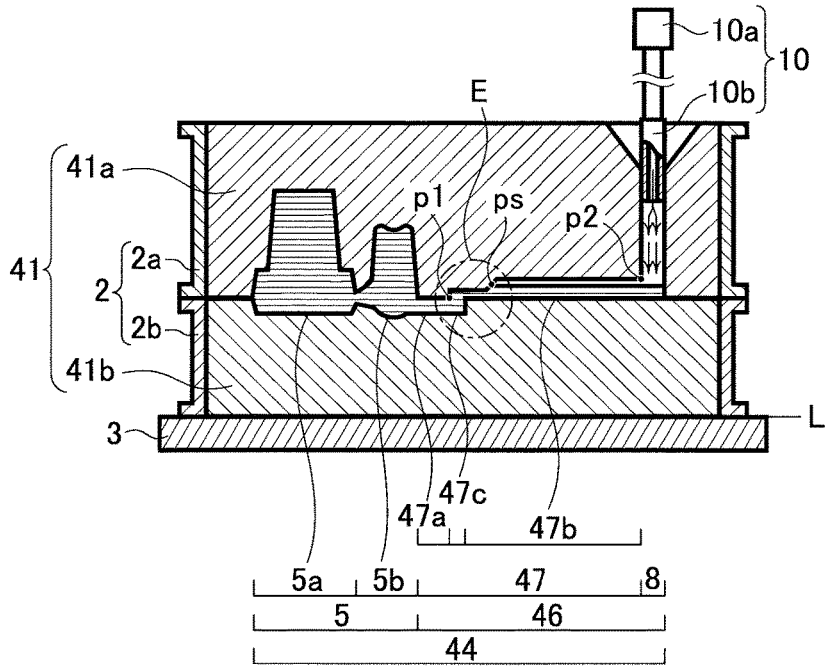
FIG. 5(*a*) is a schematic view showing an equilibrium state of a hypothetical liquid pushed into a production cavity by a gas supplied in Embodiment 5 of the present invention.
Figure 5B:
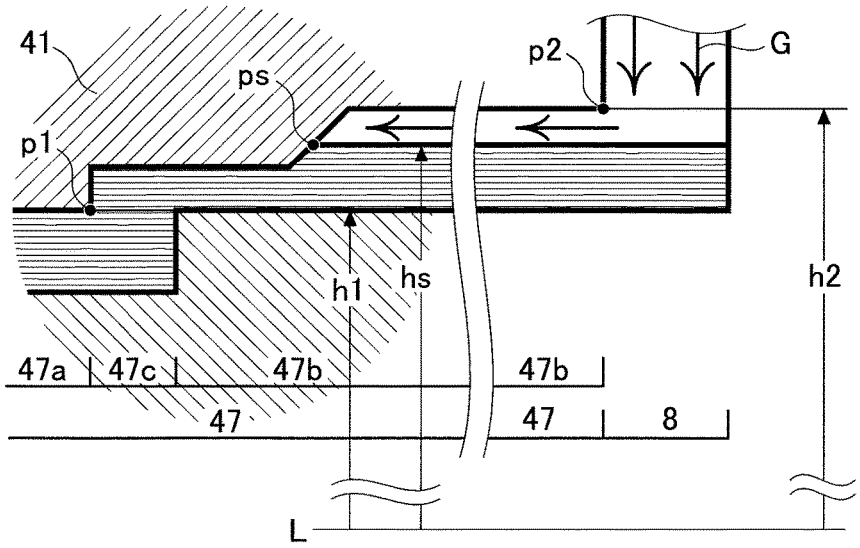

FIGS. 5(*a*) and 5(*b*) show a hypothetical equilibrium state of charging a liquid Q according to Embodiment 5 of the present invention. Embodiment 5 is the same as Embodiment 1 in the basic structure of a gas-permeable casting mold, except that a casting mold 41 comprises a runner 47 having a downward-bent flow path 47*c* and a ceiling portion downward inclined toward a production cavity 5 in its intermediate portion. Also the same as in Embodiment 1 are steps until a liquid Q poured into the casting mold is statically pushed upward into a production cavity 5 by the supplying pressure of a gas G.

FIG. 5(*a*) shows a vertical cross section of a cavity 44, and FIG. 5(*b*) enlargedly shows a portion E encircled by a chain line, which includes a downward-bent flow path 47*c*. In Embodiment 5, the liquid Q continuously fills the runner 47 up to a liquid surface Sv as high as a point Ps, after filling the production cavity 5.

With the runner 47 having a horizontal runner portion 47*a* on the side of the production cavity 5 from the downward-bent flow path 47*c*, and a horizontal runner portion 47*b* on the side of the sprue 8 from the downward-bent flow path 47*c*, the lowest ceiling point p1 of the runner 47 corresponds to the lowest ceiling portion of the runner 47*a*.

In Embodiment 5 comprising the downward-bent flow path 47*c*, too, the intrusion of a gas G into the production cavity 5 can be prevented by setting the volume of the liquid Q to meet the relation of hs>h1, wherein h1 is the height of the lowest ceiling point p1 of the runner 47 constituting the flow path 46, and hs is the height of the liquid surface Sv. As in Embodiments 1-4, the liquid surface Sv can be located at a position meeting h2>hs>h1 in the runner 47, reducing the volume of the liquid Q.

Because a runner 47*b* having a low ceiling near a connecting point of the runner 47*b* to the runner 47*c* in Embodiment 5 is thinner than in Embodiment 3, the solidification of a melt in this portion is accelerated in actual casting, thereby quickly stopping the reverse flow of a melt from the production cavity 5. A low ceiling portion of the runner 47*b* may be wide as in Embodiment 4.

The volume of a metal melt poured in actual gas-pressurized casting is equal to the volume of a liquid Q continuously occupying the production cavity 5 and up to a liquid surface Sv in a hypothetical equilibrium state shown in FIG. 5(*a*).

Embodiment 6

FIGS. 6(*a*) and 6(*b*) show one example of gas-permeable casting molds according to Embodiment 6 of the present invention. In the basic structure of the gas-permeable casting mold in Embodiment 6, a casting mold 51 comprises a runner 57 having a downward-bent flow path 59 in its intermediate portion, like the gas-permeable casting mold shown in FIG. 3(*d*).

In the gas-permeable casting mold in Embodiment 6, a runner 57 has a substantially vertical downward-bent flow path 59 for generating downward flow in its intermediate portion. An upper portion of the downward-bent flow path 59 is connected to a runner 57*b* extending to a sprue 8, and a lower portion of the downward-bent flow path 59 is connected to a runner 57*a* extending to the production cavity 5. Thus, the runner 57 is constituted by a horizontal runner 57*a* on the side of the production cavity 5 from the downward-bent flow path 59, a horizontal runner 57*b* on the side of the sprue, and the downward-bent flow path 59. Though FIGS. 6(*a*) and 6(*b*) show a substantially vertical downward-bent flow path 59, the downward-bent flow path 59 may be inclined from the sprue 8 toward the production cavity 5. The same is true in Embodiment 7.

The height H1 of the point P1, at which the ceiling of the runner 57*a* extending from the downward-bent flow path 59 to the production cavity 5 is connected to the downward-bent flow path, and the height H2 of the lowest ceiling portion P2 of the horizontal runner portion 57*b* extending from the sprue 8 to the downward-bent flow path meet the relation of H1<H2. With the downward-bent flow path 59 meeting H1<H2, even a gas flowing toward the production cavity 5 along the ceiling of the runner 57*b* by the variations of pressure, flow rate, etc. of the gas can be stopped by the downward-bent flow path 59 to prevent it from flowing forward. On the other hand, in a conventional gas-permeable casting mold having a linear horizontal runner with no downward-bent flow path 59 as shown in FIG. 8(*a*), for example, a melt should be solidified against gravity in the runner to reduce the amount of a melt existing in the runner, needing a high-accuracy pressure-controlling means, and a quick melt-cooling means.

As shown in FIG. 6(*b*), the height H3 of a point P3, at which a bottom of the horizontal runner 57*b* on the side of the sprue is connected to the downward-bent flow path, preferably meets H1<(H2+H3)/2.

Though FIGS. 6(*a*) and 6(*b*) show an example that the runner 57*b* has a horizontal ceiling having an even height, the gas-permeable casting mold of the present invention is not restricted to comprise a runner having such a shape, but the runner 57*b* may have an upward or downward inclined ceiling, may be in a stepped or bent shape, or may be inclined upward or downward.

Though the downward-bent flow path 59 may be located at an arbitrary position in the horizontal runner 57, it is preferably as close to the production cavity 5 as possible, to reduce the amount of a melt poured. The same is true in Embodiment 7.

Embodiment 7

Figure 7A:
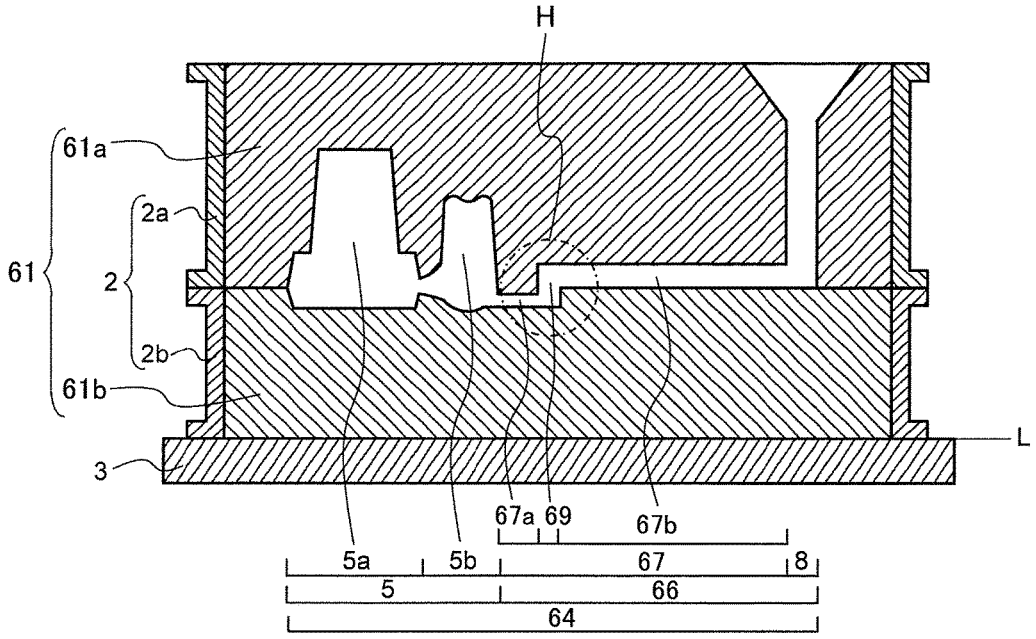
FIG. 7(*a*) is a schematic view showing an example of gas-permeable casting molds in Embodiment 7 of the present invention.
Figure 7B:
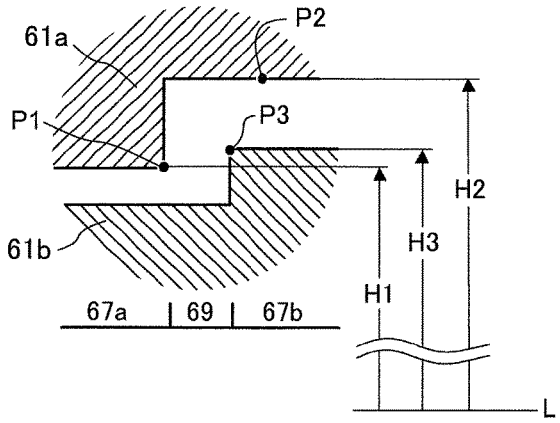
Figure 8A:
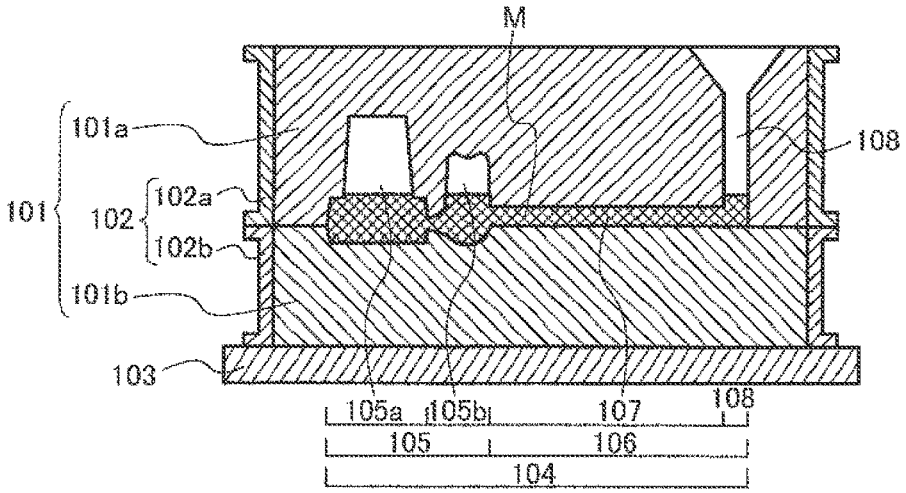
Fig. 8(a) PRIOR ART
FIG. 8(*a*) is a schematic view showing a step in the gas-pressurized casting described in JP 2007-75862 A and JP 2010-269345 A.
Figure 8B:
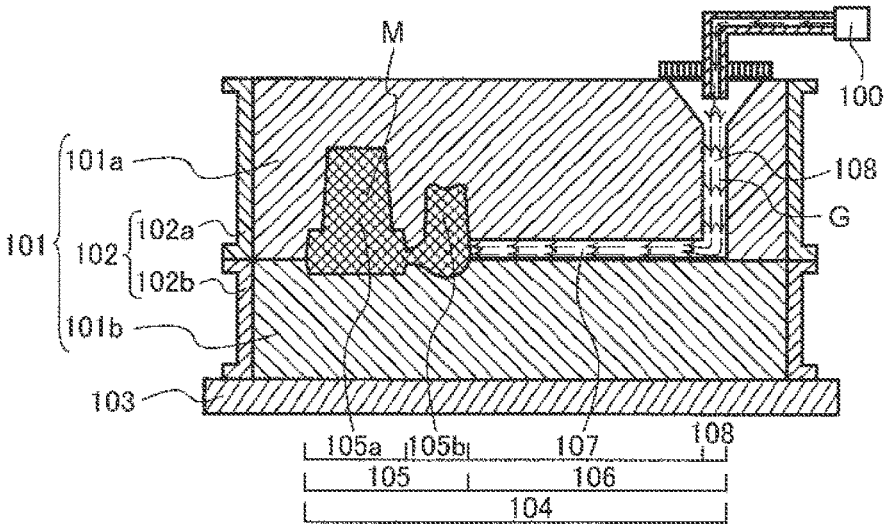
Fig. 8(b) PRIOR ART
Figure 8C:
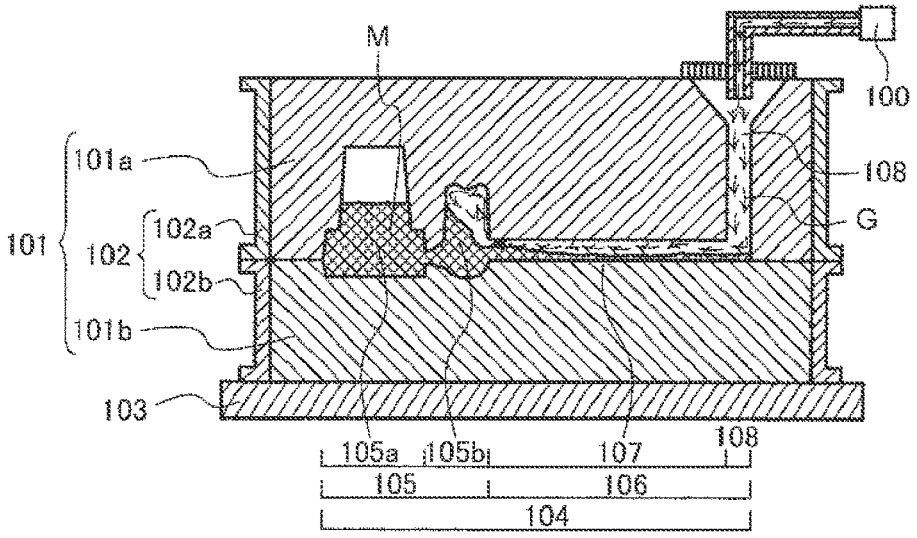
Fig. 8(c) PRIOR ART

FIGS. 7(*a*) and 7(*b*) show an example of gas-permeable casting molds according to Embodiment 7 of the present invention. The basic structure of a gas-permeable casting mold in Embodiment 7 is the same as in Embodiment 6, except that a downward-bent flow path 69 meets H1≤H3, wherein H1 is the height of a point P1 at which a ceiling of the runner 67*a* on the side of the production cavity 5 is connected to the downward-bent flow path, and H3 is the height of a point P3 at which a bottom of the runner 67*b* on the side of the sprue is connected to the downward-bent flow path. Embodiment 7 is a further preferred example of the gas-permeable casting molds of the present invention.

In this embodiment, when the point P1 at which the ceiling of the runner 67*a* is connected to the downward-bent flow path, and the point P3 at which the bottom of the runner 67*b* on the side of the sprue is connected to the downward-bent flow path have the same height, H1=H3, for example, on the same parting surface, the upper mold 1*a* and the lower mold 1*b* can be easily combined.

When the point P1 at which the ceiling of the runner 67*a* is connected to the downward-bent flow path is lower than the point P3 at which the bottom of the runner 67*b* on the side of the sprue is connected to the downward-bent flow path, H1<H3 as shown in FIG. 7(*b*), a melt surface pushed downward by the gas in the downward-bent flow path 69 can be lower than the lowest point P3, surely reducing the amount of a melt remaining in the runner 67*b* in a more preferred manner.

What is claimed is:

1. A gas-permeable casting mold comprising a cavity composed of a production cavity and a flow path, said flow path comprising a sprue through which a gravity-poured melt flows downward, and a runner connecting said production cavity to said sprue for gravity-pouring a metal melt, and then supplying a gas through said sprue to push said metal melt in said flow path, thereby pushing said metal melt upward in said production cavity, so that the desired cavity portion is filled with said metal melt;

said runner comprising a downward-bent flow path provided in an intermediate portion thereof for generating downward flow, a sprue-side flow path connecting an upper portion of the downward-bent flow path to said sprue, and a production-cavity-side flow path connecting a lower portion of the downward-bent flow path to said production cavity; and a height H1 of a point P1 at which a ceiling of said production-cavity-side flow path is connected to said downward-bent flow path, and a height H2 of a lowest ceiling portion P2 of said sprue-side flow path meeting H1<H2, wherein a height H3 of a point P3, at which a bottom of said sprue-side flow path is connected to said downward-bent flow path, meets H1<H3.

* * * * *